US005797671A

United States Patent [19]

Gess

[11] Patent Number: 5,797,671

[45] Date of Patent: Aug. 25, 1998

[54] LUMINARIA FRAME

[76] Inventor: Lawrence R. Gess, 523 W. Cossitt Ave., LaGrange, Ill. 60525

[21] Appl. No.: 494,602

[22] Filed: Jun. 23, 1995

[51] Int. Cl.[6] ..... F21L 19/00

[52] U.S. Cl. ..... 362/162; 362/352; 362/450

[58] Field of Search ..... 362/161, 162, 362/314, 352, 450

[56] References Cited

U.S. PATENT DOCUMENTS

| | | | |
|---|---|---|---|
| 121,923 | 12/1871 | Wright . | |
| 369,737 | 9/1887 | Ray | 362/162 |
| 611,898 | 10/1898 | Eastman . | |
| 3,826,455 | 7/1974 | O'Donnell | 248/97 |
| 4,810,031 | 3/1989 | Patterson | 297/192 |
| 4,907,140 | 3/1990 | Overstreet | 362/162 |
| 5,034,868 | 7/1991 | Stelfox et al. | 362/352 |
| 5,178,451 | 1/1993 | Henry | 362/161 |
| 5,226,726 | 7/1993 | Chen | 362/352 |
| 5,255,169 | 10/1993 | Koch | 362/162 |

*Primary Examiner*—Stephen F. Husar
*Attorney, Agent, or Firm*—Banner & Witcoff, Ltd.

[57] ABSTRACT

A luminaria frame comprises supports and braces, where each support has upstanding legs, and each brace defines spaced leg apertures. When each brace is assembled with the supports, a leg of each support is placed in the leg apertures of the brace. The other brace has the other legs of each support placed in the leg apertures of the other brace. The supports and braces thereby form a unified framework in which the supports and braces are movable relative to each other such that the framework collapses for storage and expands to hold a bag about the framework to form a luminaria with a candle placed, as desired, inside. As a result of this construction, the frame requires assembly only once, and otherwise requires only movement of the supports and braces relative to each other to change from a compact and collapsed storage positioning of the supports and braces, to an expanded usage positioning of the supports and braces. As preferred, the supports are twin U supports and the braces are twin braces.

6 Claims, 1 Drawing Sheet

LUMINARIA FRAME

BACKGROUND OF THE INVENTION

This invention relates to luminaria, and the supports of luminaria.

Luminaria are gaining increasing popularity for lighting walkways on special occasions, such as Christmas and outdoor gatherings. Typically, they are paper bags with their bottoms filled with sand, with candles set in the sand. The candles are lit, and the bags glow outwardly from the interior light. The glow of rows of luminaria can be pleasing and inviting.

Unfortunately, the tops of most paper bags blow around in strong winds. Sometimes the bags move out of position. Sometimes the candles blow out. Sometimes the bags start on fire. Also, wet bags, and sometimes even dry bags, disintegrate during handling. Sand, or alternately used materials such as stones and cat litter, spill and require clean-up. Bags freeze in place and cannot be removed. Further, even assuming no bag damage, the heavy fill for the bags must be purchased in bulk before use, placed in the bags, and stored or dumped after use, all requiring time, energy and strength.

Good solutions to many of the problems of luminaria are found in U.S. Pat. Nos. 5,255,169; 5,178,451; and 5,034,868, but in each invention of each such patent, the invention leaves problems unsolved. In U.S. Pat. No. 5,255,169 a heavy block substitutes for fill and wires hold the bag open, but for compact storage, disassembly and re-assembly are required. In colder climates the water can freeze in use. In U.S. Pat. No. 5,178,459, water fills a plastic container and substitutes for fill, but nothing holds the bag and handling water is required. In U.S. Pat. No. 5,034,868, an elaborate frame holds the bag, but elaborate assembly and disassembly are required, and electric lights are substituted for the charm of candles.

SUMMARY OF THE INVENTION

An object of the present invention is to advance the specifics of luminaria supports beyond those identified above, to gain in a single structure more of the benefits and fewer of the detriments of the several identified structures.

Another object is to eliminate fill and its attendant problems, minimize bag wind and weather damage from candles, retain candles in the luminaria, and provide a structure which requires little or no assembly or disassembly while simultaneously minimizing storage space requirements.

These and other objects and advantages are found in a luminaria frame which comprises supports and braces, where each support has upstanding legs, and each brace defines spaced leg apertures. When each brace is assembled with the supports, a leg of each support is placed in the leg apertures of the brace. The other brace has the other legs of each support placed in the leg apertures of the other brace. The supports and braces thereby form a unified framework in which the supports and braces are movable relative to each other such that the framework collapses for storage and expands to hold a bag about the framework to form a luminaria with a candle placed, as desired, inside. As a result of this construction, the frame requires assembly only once, and otherwise requires only movement of the supports and braces relative to each other to change from a compact and collapsed storage positioning of the supports and braces, to an expanded usage positioning of the supports and braces.

The full range of objects, advantages and features of the invention will only be understood by consideration of the preferred embodiment of the invention. The preferred embodiment is described next, in reference to the accompanying drawing. A brief description of that drawing precedes the description of the preferred embodiment.

BRIEF DESCRIPTION OF THE DRAWING

The accompanying drawing consists of a single figure, which is a perspective view of the preferred frame of the invention, shown with a candle and bag which are separate from the preferred embodiment, although used with the preferred embodiment. The bag is shown with a portion removed, for ease of illustration.

DETAILED DESCRIPTION OF THE PREFERRED EMBODIMENT

Figure 1:
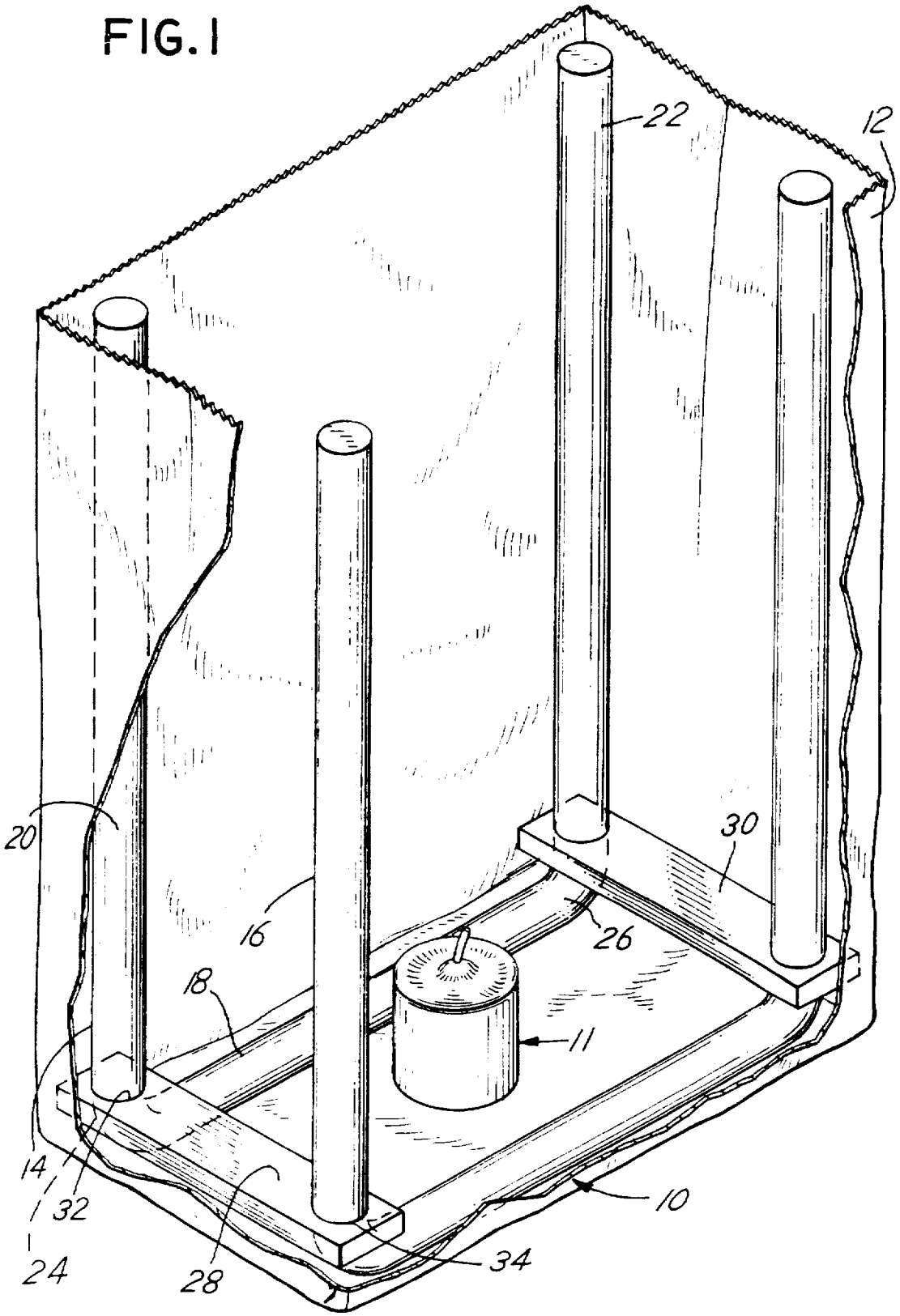

Referring to the drawing, a preferred luminaria frame 10 according to this invention holds a bag 12 in position on the ground or an equivalent base. The frame 10 also hold the bag 12 in its expanded, open topped condition. As the bag is rectangular, so is the frame. Square and other shape bags can be held by other shapes of the preferred frame. A candle 11 sits in the interior of the bag 12 and frame 10.

The frame 10 includes two supports 14, 16, which as shown are most preferably twin U supports. The supports 14, 16 are "twin" in the sense that they are substantially identical in construction. The supports 14, 16 are "U" supports in that they each form a "U" shape when upright as in position to hold a bag and viewed from the side.

Each support 14, 16 as shown in reference to support 14, includes a base or base section 18, and two spaced legs 20, 22. The base sections 18 are elongated and tubular, as are the legs 20, 22. The base sections 18 are joined at the ends thereof to the legs 20, 22 by tubular bends 24, 26. Thus, as most preferred, the supports 14, 16 are formed of tubular metal, fiberglass, plastic, pressed fiber or the like, bent or otherwise formed such that except as to the bends 24, 26, the bases 18 and legs 20, 22 of each support 14, 16 form three sides of a rectangle.

The frame 10 further includes two braces 28, 30. The braces 28, 30 are most preferably "twin" braces in the sense that they are substantially identical in construction. As shown in reference to brace 28, each brace is a bar of metal, fiberglass, plastic, pressed fiber or the like which extends the internal width of a bag 12 between the supports 14, 16. Each brace defines two spaced, twin U leg apertures 32, 34, and each brace when assembled with the U supports has a U leg of each U support placed in the U leg aperture of the brace. As most preferred, the diameters of the apertures 32, 34 are matched to the diameters of the support legs such that the legs are easily slid into the apertures until the braces rest adjacent the bends 24, 26.

By their assembly as described, the supports 14, 16 and the braces 28, 30 form a unified framework. Structure and rigidity is provided to the bag 12. Further, the supports and braces are movable and pivotable relative to each other, horizontally, in the normal upright position of the frame, such that the supports 14, 16 may be brought next to each other, albeit shifted laterally. Thus, the framework of the supports 14, 16 and braces 28, 30 collapses for storage. The collapsed framework then readily expands to original condition, to hold a bag about the framework to form a luminaria with a candle placed, as desired, inside, as in the figure.

As a result of this construction, as described, the frame 10 requires assembly only once, and only that the braces 28, 30 be slipped over the legs of the supports 14, 16. Otherwise, the frame 10 requires only movement of the supports and braces relative to each other to change from a compact and collapsed storage positioning of the supports and braces, i.e., a flattening of the frame 10, to an expanded usage positioning of the supports and braces.

The preferred embodiment of the invention and the invention itself are now described in such full, clear and concise terms as to enable a person of ordinary skill in the art to make and use the invention. A variety of variations on the preferred embodiment are possible. Therefore, to particularly point out and distinctly claim the subject matter regarded as invention, the following claims conclude this specification.

What is claimed is:

1. A luminaria frame comprising:

supports, each support having upstanding legs; and braces, each brace defining spaced leg apertures, each brace when assembled with the supports having a leg of each support placed in the leg apertures of the brace, with the other brace when assembled with the supports having other legs of each support placed in the leg apertures of the other brace, the supports and braces thereby forming a unified framework, the supports and braces movable relative to each other such that the framework collapses for storage and expands to hold a bag about the framework to form a luminaria with a candle placed, as desired, inside;

whereby the frame requires assembly once, and otherwise requires only movement of the supports and braces relative to each other to change from collapsed storage to expanded use.

2. A luminaria frame as in claim 1, the supports each including a flat base between the legs of each support, the base connecting the legs together and the bases holding a bag placed on the frame flat to the ground.

3. A luminaria frame as in claim 1, the supports being U supports.

4. A luminaria frame as in claim 1, the supports being twin U supports.

5. A luminaria frame as in claim 1, the braces being twin braces.

6. A luminaria frame comprising:

twin U supports, each U support having twin upstanding U legs; and twin braces, each brace defining spaced twin U leg apertures, each brace when assembled with the U supports having a U leg of each U support placed in the U leg apertures of the brace, with the other brace when assembled with the U supports having other U legs of each U support placed in the U leg apertures of the other brace, the U supports and braces thereby forming a unified framework, the U supports and braces movable relative to each other such that the framework collapses for storage and expands to hold a bag about the framework to form a luminaria with a candle placed, as desired, inside.

* * * * *